US009799463B2

(12) United States Patent
Yoo et al.

(10) Patent No.: US 9,799,463 B2
(45) Date of Patent: Oct. 24, 2017

(54) AUTOMATIC CONTROL DEVICE FOR PADLOCK

(71) Applicant: METIS CO., LTD., Cheonan-si, Chungcheongnam-do (KR)

(72) Inventors: Heung-Ryol Yoo, Cheonan-si (KR); Chung-Yeop Sin, Cheonan-si (KR); Cheol-Ho Jeong, Cheonan-si (KR); Byung-Rae Hyung, Asan-si (KR)

(73) Assignee: METIS CO., LTD. (KR)

( * ) Notice: Subject to any disclaimer, the term of this patent is extended or adjusted under 35 U.S.C. 154(b) by 0 days.

(21) Appl. No.: 15/211,167

(22) Filed: Jul. 15, 2016

(65) Prior Publication Data

US 2016/0329169 A1 Nov. 10, 2016

Related U.S. Application Data

(63) Continuation of application No. PCT/KR2014/011982, filed on Dec. 8, 2014.

(30) Foreign Application Priority Data

Jan. 16, 2014 (KR) ..... 10-2014-0005539

(51) Int. Cl.

| | |
|---|---|
| ***H01H 9/28*** | (2006.01) |
| ***H01H 71/70*** | (2006.01) |
| ***H01H 71/12*** | (2006.01) |
| *H01H 71/66* | (2006.01) |

(52) U.S. Cl.

CPC ..... *H01H 9/281* (2013.01); *H01H 71/12* (2013.01); *H01H 71/70* (2013.01); *H01H 2071/665* (2013.01)

(58) Field of Classification Search

CPC ..... H01H 9/281; H01H 71/12; H01H 71/70; H01H 2071/665; H01H 9/282; H02B 11/127; H02B 11/24; H02B 11/167; H02B 11/173

USPC ..... 200/43.14, 43.08, 43.15, 43.11–43.13, 200/43.16; 335/21, 168

See application file for complete search history.

(56) References Cited

U.S. PATENT DOCUMENTS

| | | | | |
|---|---|---|---|---|
| 3,657,672 A * | 4/1972 | Flick | ..... | H01H 71/128 335/168 |
| 7,227,092 B2 * | 6/2007 | Low | ..... | H01H 9/282 200/43.14 |
| 9,299,522 B2 * | 3/2016 | Sudhakar | ..... | H01H 71/0221 |

* cited by examiner

*Primary Examiner* — Edwin A. Leon
(74) *Attorney, Agent, or Firm* — Park & Associates IP Law, P.C.

(57) ABSTRACT

The present invention relates to an automatic control device for a padlock which enables automatic control of the padlock connected to a circuit breaker installed in a distribution board of semiconductor or LCD equipment. In the present invention, a pair of cylinders, which can supply and cut off electric power to and from a load terminal, is directly installed on top of the circuit breaker installed in the distribution board, so that a switch of the circuit breaker is turned on/off as the pair of cylinders selectively operates according to an external control signal. As a result, it is unnecessary to separately install the padlock for switching on/off the circuit breaker.

6 Claims, 9 Drawing Sheets

AUTOMATIC CONTROL DEVICE FOR PADLOCK

REFERENCE TO RELATED APPLICATIONS

This is a continuation of pending International Patent Application PCT/KR2014/011982 filed on Dec. 8, 2014, which designates the United States and claims priority of Korean Patent Application No. 10-2014-0005539 filed on Jan. 16, 2014, the entire contents of which are incorporated herein by reference.

FIELD OF THE INVENTION

The present invention relates to an automatic control device for a padlock, and more particularly, to an automatic control device for a padlock that is capable of automatically controlling the padlock connected to a circuit breaker disposed on a distribution board of semiconductor or LCD equipment.

BACKGROUND OF THE INVENTION

Generally, a circuit breaker disposed on a distribution board of semiconductor or LCD equipment is a device having a function of cutting off, when fault current such as leakage current or overcurrent occurs on a line, the supply of the fault current to the distribution board. The circuit breaker has a padlock (external manipulating handle) operating cooperatively with a door of the distribution board to cut off electric power when the door is open and to supply electric power when the door is closed.

As shown in FIG. 1, a conventional padlock, which is disclosed in Korean Patent Registration No. 10-2004-0107303 (entitled 'external manipulating handle device of circuit breaker for distribution'), includes: a handle case 50 serving as a support for internal components thereof upon the operations of the internal components and having a handle fastenedly assembled to a circuit breaker for distribution; a manipulating handle 20 attached to top of the handle case 50 to allow the handle to be manipulated to the outside by means of the rotation thereof; a pinion gear 80 connected to the manipulating handle 20 to transmit the rotary force of the manipulating handle 20; a rack gear 90 engaged with the pinion gear 80 to transfer a rotary motion to a linear motion and thus to manipulate the handle; and guide rails 100 fixed to the handle case 50 to guide the operation of the rack gear 90.

According to the external manipulating handle device of the circuit breaker for distribution, the manipulating handle 20 mounted on the door of the distribution board is operated so that the pinion gear 80, the rack gear 90, the guide rails 100, and the handle 70 are cooperatively operated with each other, thereby turning on/off the circuit breaker for distribution. That is, the conventional external manipulating handle device is disposed separately from a circuit breaker for the distribution board and is manually manipulated to the outside of the distribution board.

In addition, the circuit breaker for the distribution board is disposed near to the door by means of the manipulating handle 20, thereby making it difficult to ensure the space of the distribution board itself, and a separate device for the manual manipulation of the manipulating handle 20 is needed, thereby making the whole configuration complicated and lowering the reliability of the external manipulating handle device.

Further, as shown in FIG. 2, there is proposed a motor interlock device of a circuit breaker for distribution, which is disclosed in Korean Utility Model Registration No. 20-2005-0030166, including: a motor 302 for generating a rotary motion; an axle 304 connected to the motor 302 in such a manner as to move forward and backward in left and right directions according to the rotary directions of the motor 302; and an operator 306 adapted to apply a force to one of two handles 310 of the circuit breaker for distribution in a direction of power supply and to apply a force to the other handle in a direction of power cut-off according to the left and right motions of the axle 304.

According to the conventional motor interlock device of the circuit breaker for distribution, the inconveniences caused by the manual manipulation of the circuit breaker are removed, but the motor 302 operating by an external control signal, the axle 304 driven by the motor 302, and the operator 306 manipulating the handles 310 through the driving of the axle 304 should be disposed separately from the circuit breaker for distribution. Further, the circuit breaker for the distribution board is disposed near to the door, thereby making it difficult to ensure the space of the distribution board itself.

SUMMARY OF THE INVENTION

Accordingly, the present invention has been made in view of the above-mentioned problems occurring in the prior art, and it is an object of the present invention to provide an automatic control device for a padlock that is capable of directly disposing the padlock on a circuit breaker for a distribution board, thereby removing inconveniences caused by separate installation of the padlock from the circuit breaker.

It is another object of the present invention to provide an automatic control device for a padlock that is capable of disposing the padlock on a circuit breaker for a distribution board, thereby making the padlock simplified in configuration and ensuring the sufficient space of a distribution board.

To accomplish the above-mentioned objects, according to a first aspect of the present invention, there is provided an automatic control device for a padlock, the device including: a circuit breaker having a power terminal disposed on one side thereof, a load terminal disposed on the other side thereof, and a switch disposed on the center thereof in such a manner as to be switchedly driven from the power terminal to the load terminal; a pair of cylinders disposed on one side and the other side of the switch of the circuit breaker in such a manner as to drive cylinder rods thereof by means of an external control signal to conduct the switching operation for the switch of the circuit breaker; and operating parts adapted to push and switch the switch of the circuit breaker by means of the operations of the cylinders, each operating part having a rectangular plate-shaped push rod disposed on the front end periphery of each cylinder rod, the push rod having a coupler open upwardly from the center thereof, and a fastener having one side insertedly fastened to the coupler of the push rod and the other side fastened to each cylinder rod.

According to the present invention, desirably, the circuit breaker has a base plate disposed on top thereof, the base plate being bent downwardly on one side end and the other side end thereof, having the end portions of the downwardly bent one side end and the other side end bent outwardly and fixed to the circuit breaker, and having a guide hole formed on the center thereof in such a mariner as to insert the switch of the circuit breaker thereinto to guide the switching operation of the switch, and the base plate has one pair of fixing brackets fixed at one side and the other side on top thereof, respectively, to fix the pair of cylinders thereto.

According to the present invention, desirably, each pair of fixing brackets has both side plates larger as the fixing brackets go toward the lower portions thereof and having lower ends bent inwardly in such a manner as to be fixed to top of the base plate and fixing holes formed on the upper portions of the both side plates to fix the lower portion of each cylinder thereto.

According to the present invention, desirably, one pair of cylinders has fixing portions formed on the edge portions thereof in such a manner as to be fixed to the fixing holes of the fixing brackets and air injection holes formed on one side periphery thereof to inject air thereinto.

According to the present invention, desirably, one pair of cylinders is operated by means of pneumatic pressure.

To accomplish the above-mentioned objects, according to a second aspect of the present invention, there is provided an automatic control device for a padlock, the device including: a circuit breaker having a power terminal disposed on one side thereof, a load terminal disposed on the other side thereof, and a switch disposed on the center thereof in such a manner as to be switchedly driven from the power terminal to the load terminal; a pair of cylinders disposed on one side and the other side of the switch of the circuit breaker in such a manner as to drive cylinder rods thereof by means of an external control signal to conduct the switching operation for the switch of the circuit breaker; a switch block disposed between the cylinder rods in such a manner as to insert the switch of the circuit breaker thereinto to conduct the switching operation for the switch of the circuit breaker by mean of driving of the cylinder rods, the switch block having slide holes formed on both sides of the upper portions of one side surface and the other side surface thereof; and guide bars adapted to guide the movements of the switch block, each guide bar being passed through the slide holes of the switch block in such a manner as to allow one end thereof to be fastened to any one of the pair of cylinders and to allow the other end thereof to be fastened to the other cylinder.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Hereinafter, an explanation on an automatic control device for a padlock according to the present invention will be in detail given with reference to the attached drawing.

Figure 1:
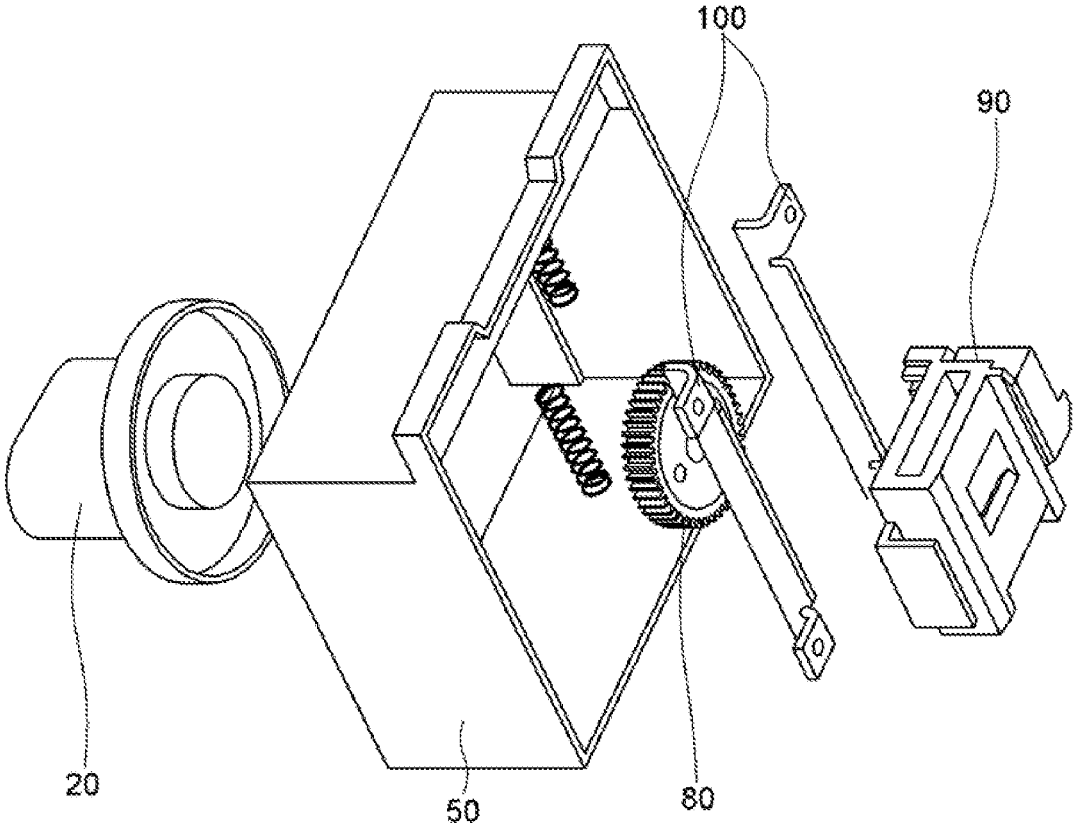
FIG. 1 (PRIOR ART)
FIG. 1 is an exploded perspective view showing a conventional external manipulating handle device of a circuit breaker for distribution.
Figure 2:
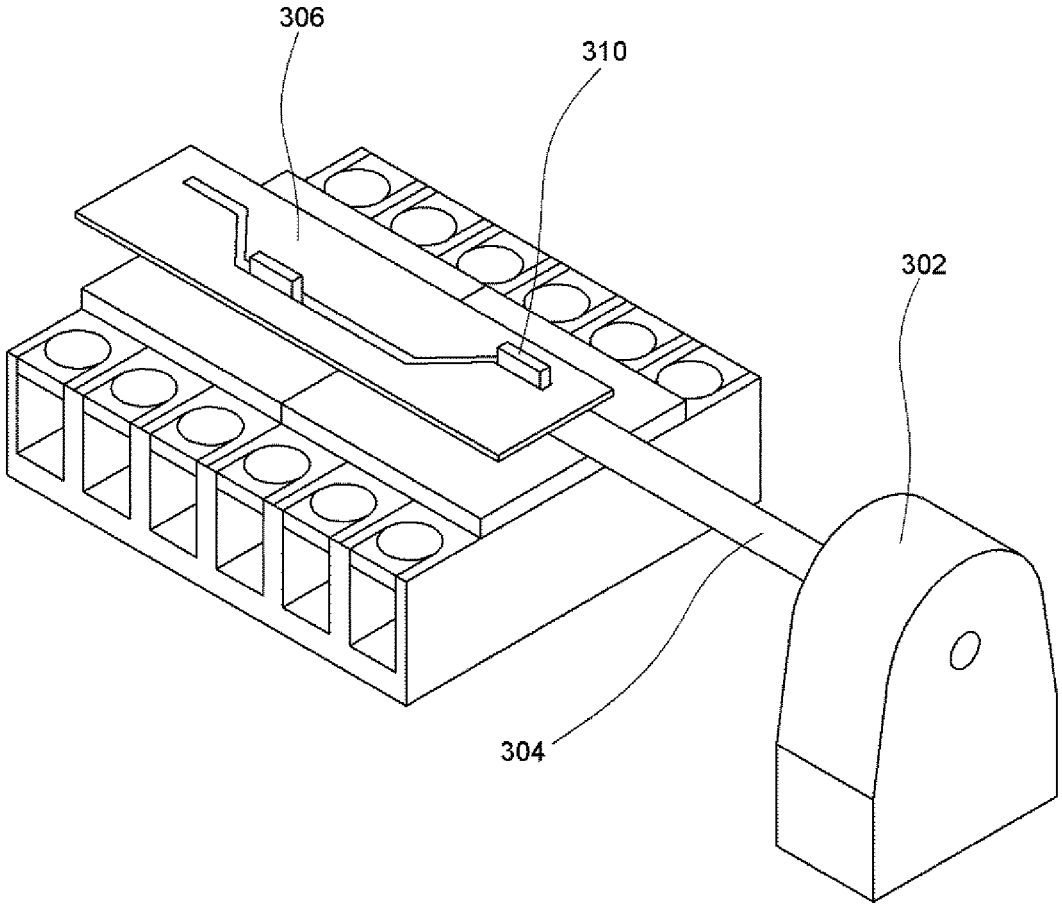
FIG. 2 (PRIOR ART)
FIG. 2 is a perspective view showing a conventional motor interlock device of a circuit breaker for distribution.
Figure 3:
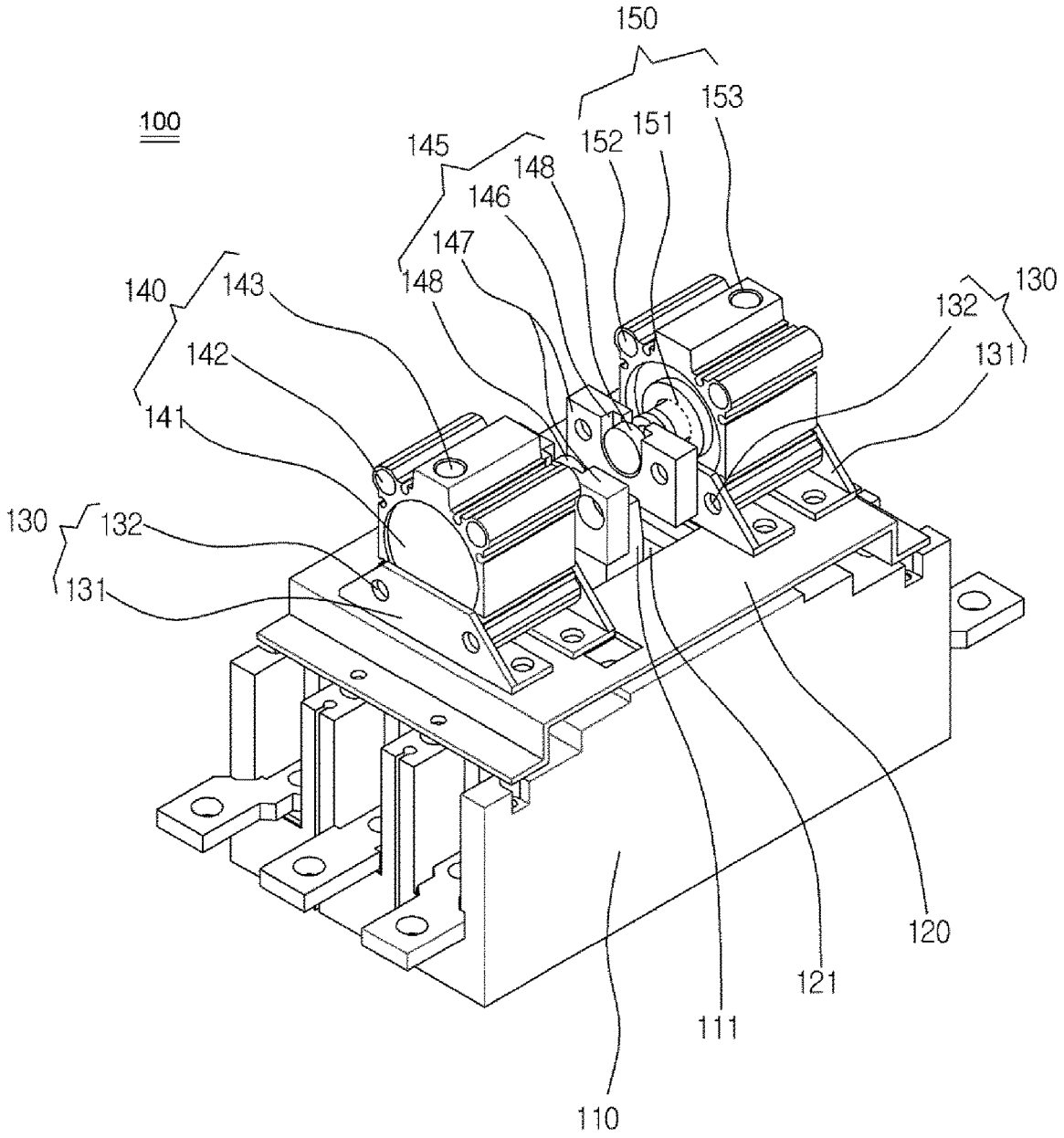
FIG. 3 is a perspective view showing an automatic control device for a padlock according to a first embodiment of the present invention.

FIG. 3 is a perspective view showing an automatic control device for a padlock according to a first embodiment of the present invention.

As shown in FIG. 3, an automatic control device 100 for a padlock according to a first embodiment of the present invention includes: a circuit breaker 110 having a switch 111 adapted to supply and cut off electric power to and from a load terminal; a base plate 120 fixedly mounted on top of the circuit breaker 110 to guide the switching operation of the switch 111; two pairs of fixing brackets 130 fixedly disposed at one side and the other side of top of the base plate 120; a pair of cylinders 140 and 150 having cylinder rods 141 and 151 fixedly disposed correspondingly on the two pairs of fixed brackets 130 and selectively operated by an external control signal to conduct the switching operation for the switch 111; and operating parts 145 coupled to the front end peripheries of the cylinder rods 141 and 151 to push and switch the switch 111 of the circuit breaker 110 by means of the operations of the cylinders 140 and 150.

Figure 4:
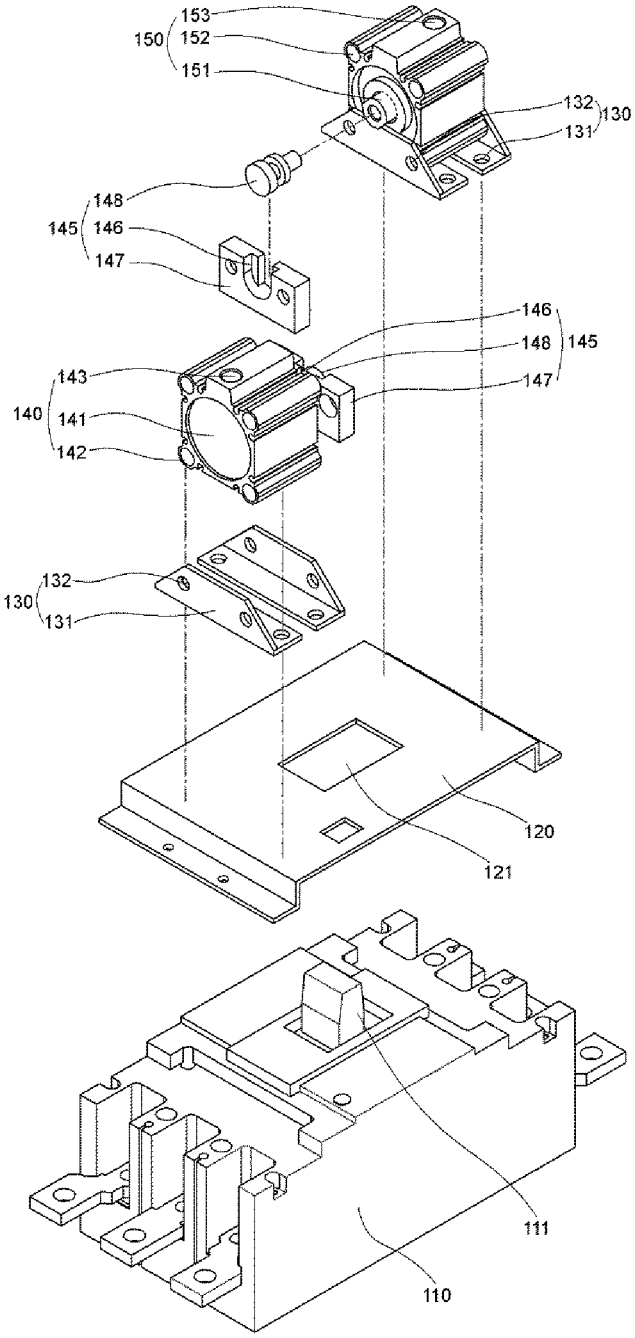
FIG. 4 is an exploded perspective view showing the automatic control device for a padlock according to the first embodiment of the present invention.

FIG. 4 is an exploded perspective view showing the automatic control device for a padlock according to the first embodiment of the present invention.

As shown in FIG. 4, the circuit breaker 110 includes a power terminal disposed on one side end thereof to receive the power from the outside, the load terminal disposed on the other side end thereof to output the power received to the power terminal therefrom, and the switch 111 disposed between the power terminal and the load terminal to supply and cut off the power received from the power terminal to and from the load terminal by means of the switching operation from the power terminal to the load terminal.

The base plate 120 is bent downwardly on one side end and the other side end thereof, and the end portions of one side end and the other side end bent downwardly of the base plate 120 are bent outwardly and fixed to the circuit breaker 110. The base plate 120 has a guide hole 121 formed on the center thereof in such a manner as to insert the switch 111 of the circuit breaker 110 thereinto and to guide the switching operation of the switch 111.

Accordingly, the base plate 120 is fixedly spaced apart from top of the circuit breaker 110 by means of the outwardly bent end portions thereof, while fixedly inserting the switch 111 of the circuit breaker 110 into the guide hole 121. As a result, the base plate 120 maintains the insulation state from the circuit breaker 110, and further, the switch 111 conducts the switching operation by means of the guide of the guide hole 121, so that the base plate 120 induces the accurate switching operation of the switch 111.

Each pair of fixing brackets 130 includes both side plates 131 larger as they go toward the lower portions thereof and having lower ends bent inwardly in such a manner as to be fixed to top of the base plate 120 and fixing holes 132 formed on the upper portions of the both side plates 131 to fix the lower portion of each cylinder thereto.

Accordingly, the inwardly bent portions of each pair of fixing brackets 130 are fixed to the base plate 120, and the fixing holes 132 formed on the upper portions thereof are adapted to fix the lower portion of each cylinder thereto.

One pair of cylinders 140 and 150 includes one pair of cylinder rods 141 and 151, fixing portions 142 and 152 formed on the outer edges thereof, and air injection holes 143 and 153 formed on one side periphery thereof to inject air thereinto.

One pair of cylinders 140 and 150 is a single acting pneumatic cylinder and forwardly moves the cylinder rods 141 and 151 by means of the air injected into the air injection holes 143 and 153.

Each operating part 145 includes a rectangular plate-shaped push rod 147 having a coupler 146 open upwardly from the center thereof and a fastener 148 having one side insertedly fastened to the coupler 146 of the push rod 147 and the other side fastened to each cylinder rod.

Accordingly, the operating parts 145 are operated together with the cylinder rods 141 and 151 of the pair of cylinders 140 and 150 and push the switch 111 of the circuit breaker 110 by means of the push rods 147 to conduct the switching operation for the switch 111, so that the power terminal and the load terminal of the circuit breaker 110 are connected or disconnected to supply or cut off the power to or from the load terminal.

Figure 5:
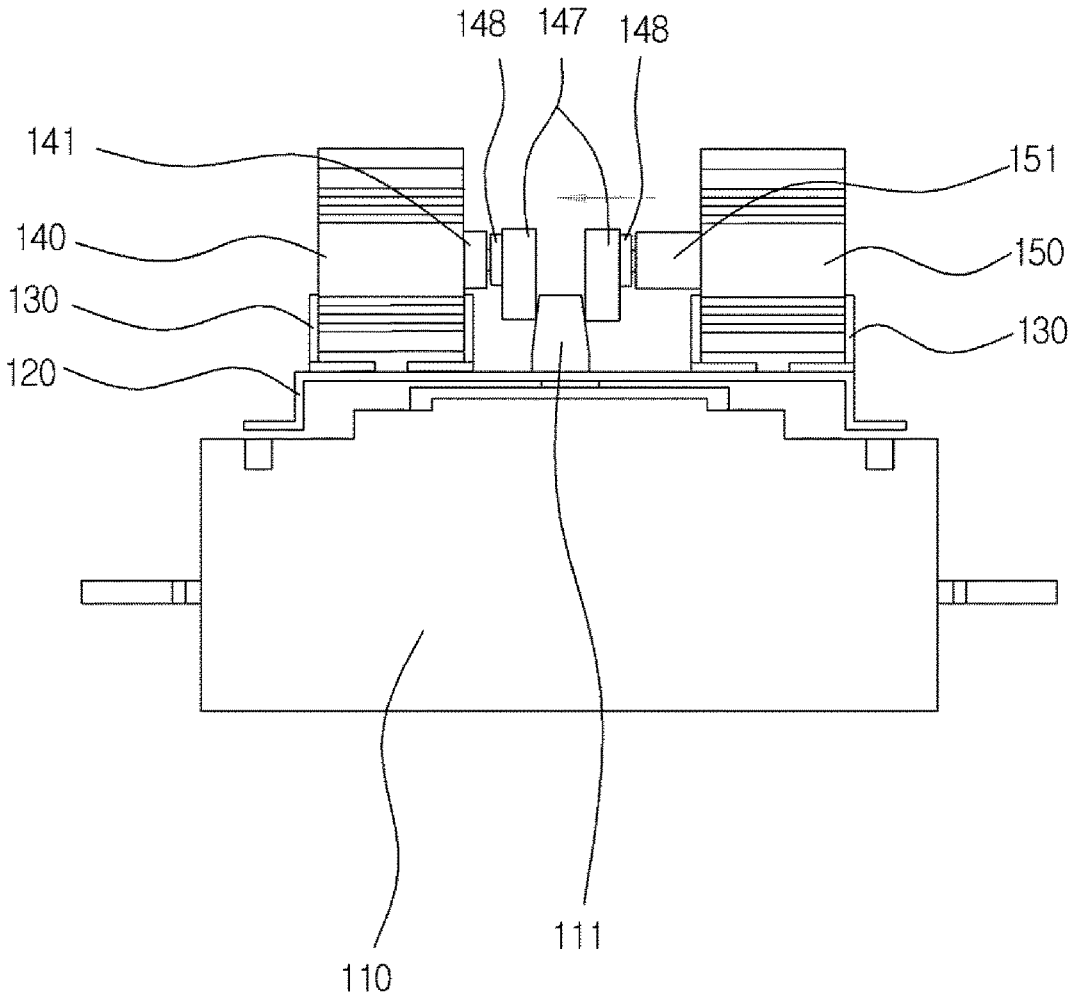
FIG. 5 is a sectional view showing the operating state of power supply of the automatic control device for a padlock according to the first embodiment of the present invention.
Figure 6:
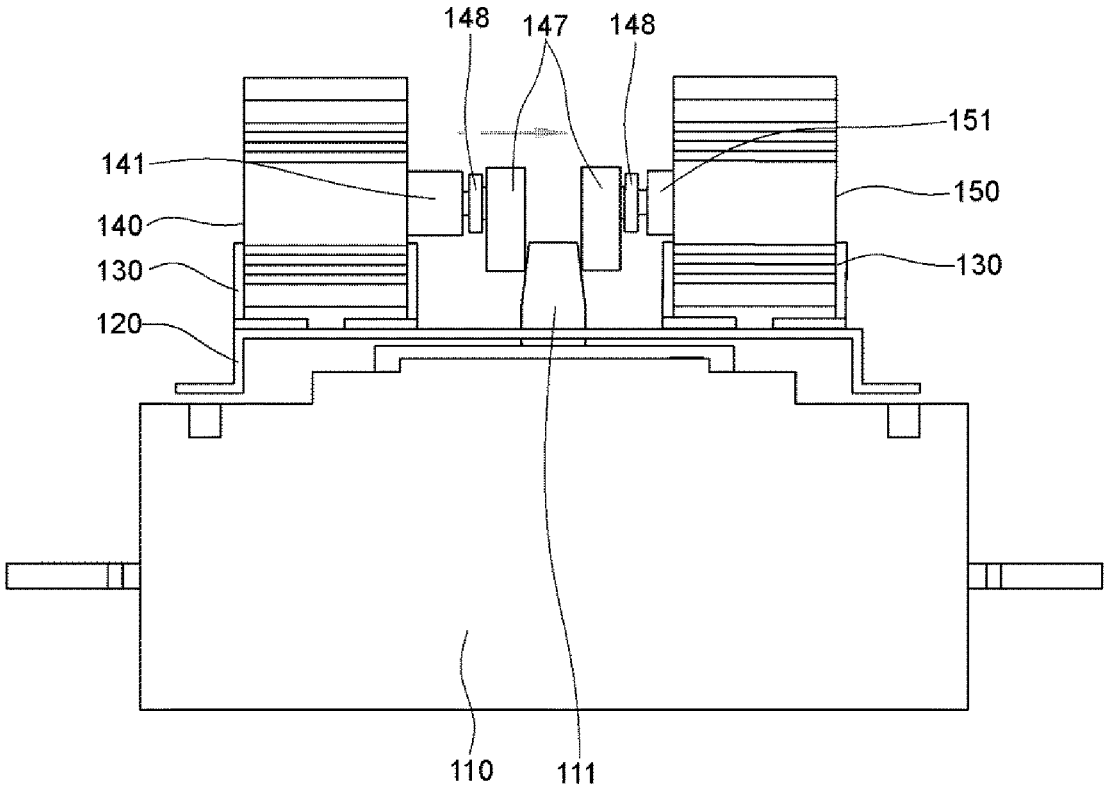
FIG. 6 is a sectional view showing the operating state of power cut-off of the automatic control device for a padlock according to the first embodiment of the present invention.

FIG. 5 is a sectional view showing the operating state of power supply of the automatic control device for a padlock according to the first embodiment of the present invention, and FIG. 6 is a sectional view showing the operating state of power cut-off of the automatic control device for a padlock according to the first embodiment of the present invention.

The base plate 120 and the two pairs of brackets 130 are fixedly mounted on top of the circuit breaker 110 disposed on a distribution board, and one pair of cylinders 140 and 150 having one pair of cylinder rods 141 and 151 are fixedly mounted on the two pairs of brackets 130 so as to conduct the switching operation for the switch 111 supplying or cutting off the power to the load terminal from the power terminal. In this state, air is injected into any one of the air injection holes 143 and 153 formed on the pair of cylinders 140 and 150, and the cylinder 140 or 150 into which the air is injected operates the cylinder rod 141 or 151 to allow the operating part 145 coupled to the cylinder rod 141 or 151 to operate the switch 111, so that the power is supplied or cut off to or from the load terminal.

Accordingly, as shown in FIG. 5, if a door of the distribution board is closed, a solenoid (not shown) is operated by an external control signal, and air is injected into the air injection hole 153 of the cylinder 150 by means of an air pump (not shown). The cylinder 150 into which the air is injected operates the cylinder rod 151 to allow the push rod 147 of the operating part 145 coupled to the front end periphery of the cylinder rod 151 to push the switch 111 of the circuit breaker 110, and the switch 111 is guided by means of the guide hole 121 formed on the base plate 120 to allow the power terminal and the load terminal to be connected to each other, so that the power is supplied to the load terminal.

On the other hand, as shown in FIG. 6, if the door of the distribution board is open, the solenoid is operated by an external control signal, and while air supply to the cylinder 150 is being cut off, air is injected into the air injection hole 143 of the cylinder 140 by means of the air pump. The cylinder 140 into which the air is injected operates the cylinder rod 141 to allow the push rod 147 of the operating part 145 coupled to the front end periphery of the cylinder rod 141 to push the switch 111 of the circuit breaker 110.

At this time, the switch 111 is pushed by means of the guide of the guide hole 121 formed on the base plate 120 to push the cylinder rod 151 of the cylinder 150, and accordingly, the cylinder rod 151 being pushed upon the supply of power is restored to its original state to allow the switch 111 to be switched from the load terminal to the power terminal, so that the power terminal and the load terminal of the circuit breaker 110 are separated from each other, thereby cutting off the power supply to the load terminal.

Figure 7:
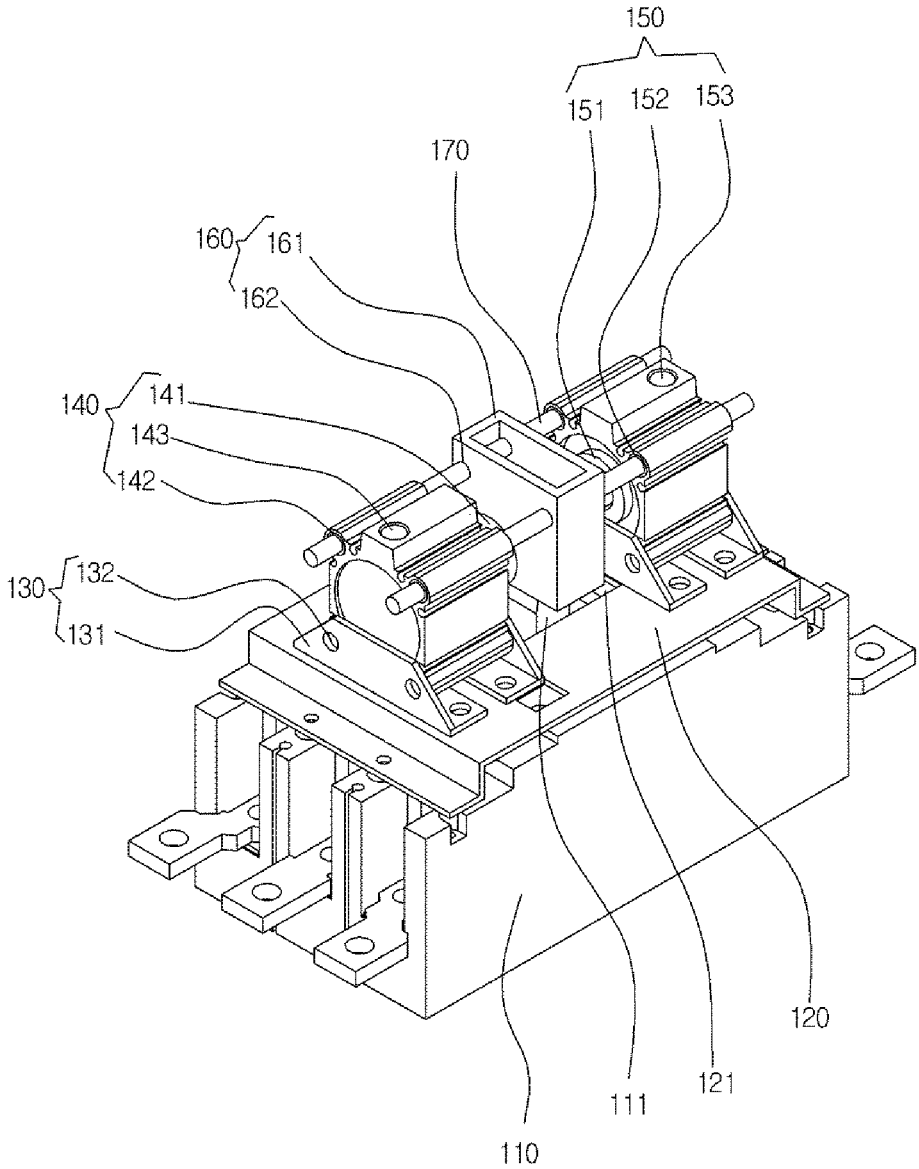
FIG. 7 is a perspective view showing an automatic control device for a padlock according to a second embodiment of the present invention.

FIG. 7 is a perspective view showing an automatic control device for a padlock according to a second embodiment of the present invention.

As shown in FIG. 7, an automatic control device 100 for a padlock according to a second embodiment of the present invention includes: a circuit breaker 110 having a switch 111 adapted to supply and cut off power to and from a load terminal; abase plate 120 fixedly mounted on top of the circuit breaker 110 to guide the switching operation of the switch 111; two pairs of fixing brackets 130 fixedly disposed at one side and the other side of top of the base plate 120; a pair of cylinders 140 and 150 having cylinder rods 141 and 151 fixedly disposed correspondingly on the two pairs of fixed brackets 130 in such a manner as to be selectively reciprocated to conduct the switching operation for the switch 111; a switch block 160 disposed between the pair of cylinders 140 and 150 to conduct the switching operation for the switch 111 of the circuit breaker 110; and guide bars 170 insertedly passed through the switch block 160 in such a manner as to be fastened to the pair of cylinders 140 and 150 at their both sides thereof to slidingly guide the switch block 160 therealong.

The switch block 160 has a rectangular body and includes a switch hole 161 penetrated up and down in the interior thereof to insert the switch 111 of the circuit breaker 110 thereinto and slide holes 162 formed on both sides of the upper portions of one side surface and the other side surface of the rectangular body to slidingly insert the guide bars 170 thereinto.

One side end and the other side end of each guide bar 170 are insertedly passed through the slide holes 162 of the switch block 160 into which the switch 111 of the circuit breaker 110 is inserted and then insertedly fixed to fixing portions 142 and 152 of the pair of cylinders 140 and 150.

Accordingly, the switch 111 of the circuit breaker 110 is inserted into the switch hole 161 of the switch block 160, and the guide bars 170 are inserted slidingly into the slide holes 162 formed on both sides of the upper portion of the switch block 160 to allow the switch 111 to be switched so that the switching operation of the switch 111 is conducted accurately by means of the switch block 160 and the guide bars 170.

Figure 8:
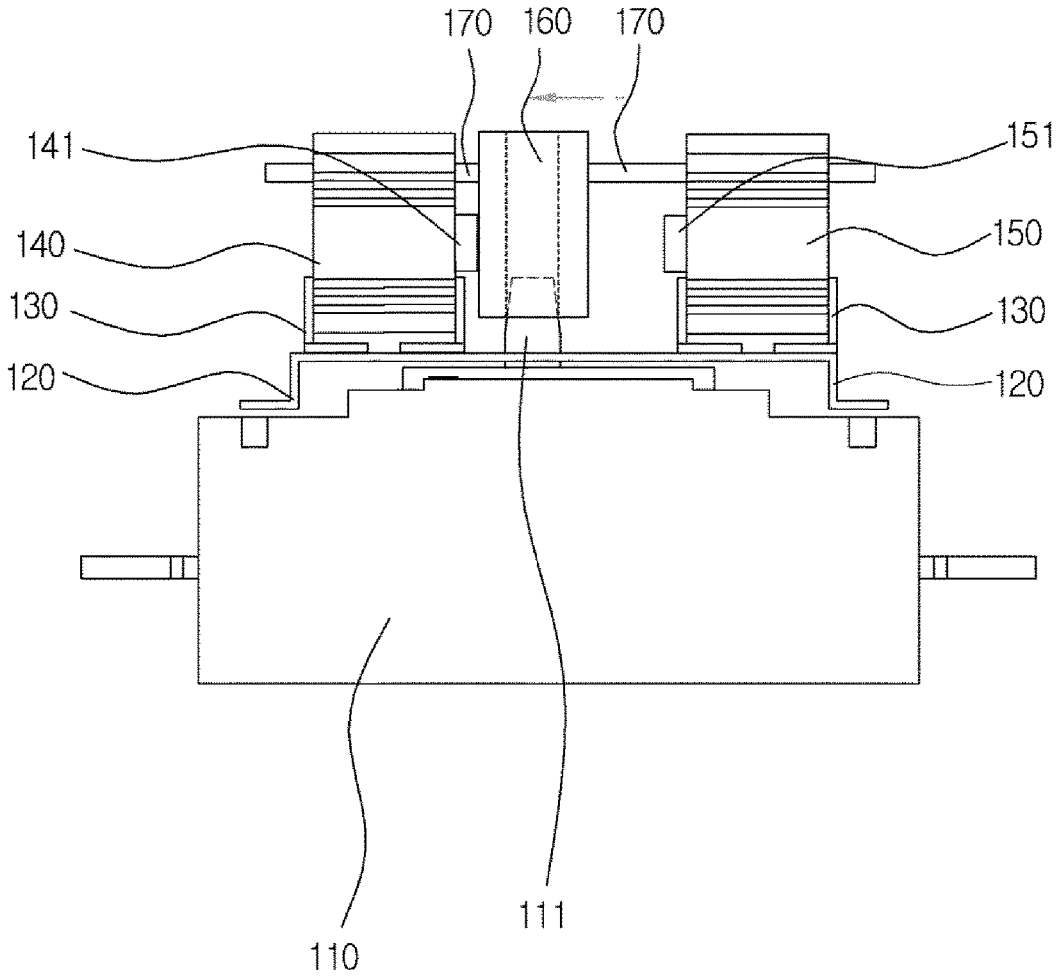
FIG. 8 is a sectional view showing the operating state of power supply of the automatic control device for a padlock according to the second embodiment of the present invention.
Figure 9:
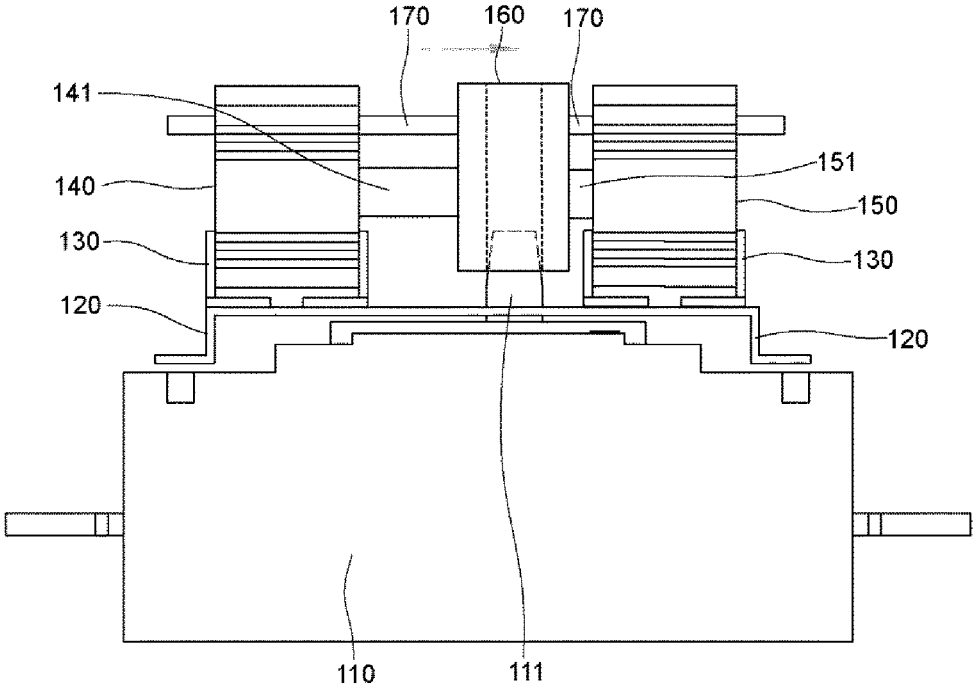
FIG. 9 is a sectional view showing the operating state of power cut-off of the automatic control device for a padlock according to the second embodiment of the present invention.

FIG. 8 is a sectional view showing the operating state of power supply of the automatic control device for a padlock according to the second embodiment of the present invention; and FIG. 9 is a sectional view showing the operating state of power cut-off of the automatic control device for a padlock according to the second embodiment of the present invention.

As shown in FIG. 8, if a door of the distribution board is closed, a solenoid (not shown) is operated by an external control signal, and air is injected into the air injection hole 153 of the cylinder 150 by means of an air pump (not shown). The cylinder 150 into which the air is injected operates the cylinder rod 151 to allow the switch block 160 into which the guide bars 170 are slidingly inserted and having the lower portion into which the switch 111 of the circuit breaker 110 is inserted to push forwardly.

Accordingly, the switch block 160 is slidingly guided by means of the guide bars 170 and moves forwardly to allow the power terminal and the load terminal to be connected to each other, so that the power is supplied to the load terminal.

As shown in FIG. 9, if the door of the distribution board is open, air supply to the cylinder 150 is cut off, and air is injected into the air injection hole 143 of the cylinder 140 by means of the air pump. The cylinder 140 into which the air is injected operates the cylinder rod 141 to allow the switch block 160 into which the guide bars 170 are slidingly inserted and having the lower portion into which the switch 111 of the circuit breaker 110 is inserted to push forwardly.

At this time, the switch 111 of the circuit breaker 110 inserted into the switch block 160 is switched from the load terminal to the power terminal by means of the switch block 160, and at this time, the switch block 160 pushes the cylinder rod 151 of the cylinder 150, and accordingly, the cylinder rod 151 is restored to its original state to allow the switch 111 to separate the power terminal and the load terminal from each other, thereby cutting off the power supply to the load terminal.

As described above, the automatic control device for a padlock according to the present invention is configured wherein one pair of cylinders is fixedly mounted on top of the circuit breaker to supply and cut off power to and from the load terminal, and thus, the cylinders are operated selectively according to the external control signal to turn on and off the switch of the circuit breaker, so that there is no need to separately provide the padlock for turning on and off the circuit breaker, thereby removing inconveniences caused by separate installation of the padlock from the circuit breaker.

In addition, the automatic control device for a padlock according to the present invention is configured wherein the padlock is disposed on the circuit breaker, thereby making the circuit board and the padlock simplified in configuration and ensuring the sufficient space of the distribution board.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An automatic control device for a padlock, the device comprising:

a circuit breaker having a power terminal disposed on one side thereof, a load terminal disposed on the other side thereof, and a switch disposed on the center thereof in such a manner as to be switchedly driven from the power terminal to the load terminal;

a pair of cylinders disposed on one side and the other side of the switch of the circuit breaker in such a manner as to drive cylinder rods thereof by means of an external control signal to conduct the switching operation for the switch of the circuit breaker; and operating parts adapted to push and switch the switch of the circuit breaker by means of the operations of the cylinders, each operating part having a rectangular plate-shaped push rod disposed on the front end periphery of each cylinder rod, the push rod having a coupler open upwardly from the center thereof, and a fastener having one side insertedly fastened to the coupler of the push rod and the other side fastened to each cylinder rod.

2. The automatic control device according to claim 1, wherein the circuit breaker has a base plate disposed on top thereof, the base plate being bent downwardly on one side end and the other side end thereof, having the end portions of the downwardly bent one side end and the other side end bent outwardly and fixed to the circuit breaker, and having a guide hole formed on the center thereof in such a manner as to insert the switch of the circuit breaker thereinto to guide the switching operation of the switch, and the base plate has one pair of fixing brackets fixed at one side and the other side on top thereof, respectively, to fix the pair of cylinders thereto.

3. The automatic control device according to claim 2, wherein each pair of fixing brackets has both side plates larger as the fixing brackets go toward the lower portions thereof and having lower ends bent inwardly in such a manner as to be fixed to top of the base plate and fixing holes formed on the upper portions of the both side plates to fix the lower portion of each cylinder thereto.

4. The automatic control device according to claim 1, wherein one pair of cylinders has fixing portions formed on the edge portions thereof in such a manner as to be fixed to the fixing holes of the fixing brackets and air injection holes formed on one side periphery thereof to inject air thereinto.

5. The automatic control device according to claim 1, wherein one pair of cylinders is operated by means of pneumatic pressure.

6. An automatic control device for a padlock, the device comprising:

a circuit breaker having a power terminal disposed on one side thereof, a load terminal disposed on the other side thereof, and a switch disposed on the center thereof in such a manner as to be switchedly driven from the power terminal to the load terminal;

a pair of cylinders disposed on one side and the other side of the switch of the circuit breaker in such a manner as to drive cylinder rods thereof by means of an external control signal to conduct the switching operation for the switch of the circuit breaker;

a switch block disposed between the cylinder rods in such a manner as to insert the switch of the circuit breaker thereinto to conduct the switching operation for the switch of the circuit breaker by mean of driving of the cylinder rods, the switch block having slide holes formed on both sides of the upper portions of one side surface and the other side surface thereof; and guide bars adapted to guide the movements of the switch block, each guide bar being passed through the slide holes of the switch block in such a manner as to allow one end thereof to be fastened to any one of the pair of cylinders and to allow the other end thereof to be fastened to the other cylinder.

* * * * *